US007182057B2

(12) United States Patent
Sato

(10) Patent No.: US 7,182,057 B2
(45) Date of Patent: Feb. 27, 2007

(54) ENGINE CYLINDER HEAD HAVING AN IMPROVED INTAKE PORT CONFIGURATION, AND ENGINE INCORPORATING SAME

(75) Inventor: Katsuhiko Sato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/219,462

(22) Filed: Sep. 2, 2005

(65) Prior Publication Data

US 2006/0048741 A1 Mar. 9, 2006

(30) Foreign Application Priority Data

Sep. 6, 2004 (JP) ..... 2004-257816

(51) Int. Cl.
*F02F 1/42* (2006.01)

(52) U.S. Cl. ..... 123/193.5

(58) Field of Classification Search ..... 123/193.5, 123/193.3, 193.1
See application file for complete search history.

(56) References Cited

U.S. PATENT DOCUMENTS 4,300,494 A * 11/1981 Graiff et al. ..... 123/193.5
4,508,066 A * 4/1985 Hartsock ..... 123/41.71
4,543,925 A * 10/1985 Ruf ..... 123/188.8
5,138,989 A * 8/1992 Fraidl et al. ..... 123/193.5
5,671,709 A * 9/1997 Sokoloski ..... 123/193.5
6,390,051 B2 * 5/2002 Hilpert et al. ..... 123/193.5
2003/0177997 A1 * 9/2003 Taylor ..... 123/193.5

FOREIGN PATENT DOCUMENTS

JP 07-301119 11/1995

* cited by examiner

*Primary Examiner*—Marguerite McMahon
(74) *Attorney, Agent, or Firm*—Carrier, Blackman & Associates, P.C.; William D. Blackman; Joseph P. Carrier

(57) ABSTRACT

A cylinder head of an internal combustion engine is provided with an improved intake port configuration, that improves the efficiency of air intake into a combustion chamber. The engine includes an intake valve which covers an opening of a combustion chamber and which has a valve stem supported by a valve guide. The valve guide is fixed to a curved wall of an intake port leading from a hole in the side of the cylinder head to the intake opening of the combustion chamber. An intake port is configured so that the cross-sectional area thereof reduces with an increasing distance from the intake opening of the combustion chamber, and so that the passage cross-sectional area at a distance equal to about 10% of the total length of the intake port from the intake opening of the combustion chamber is 0.8 times the area of opening of the combustion chamber or smaller.

12 Claims, 5 Drawing Sheets

0% passage location P0 (inlet location)

3% passage location P3

6% passage location P6

10% passage location P10

ENGINE CYLINDER HEAD HAVING AN IMPROVED INTAKE PORT CONFIGURATION, AND ENGINE INCORPORATING SAME

CROSS-REFERENCE TO RELATED APPLICATIONS

The present invention claims priority under 35 USC 119 based on Japanese patent application No. 2004-257816, filed on Sep. 6, 2004. The subject matter of this priority document is incorporated by reference herein.

BACKGROUND OF THE INVENTION

1. Field of the Invention

The present invention relates to internal combustion engines. More particularly, the present invention relates to a cylinder head for an internal combustion engine, in which the cylinder head has an improved intake port configuration, and to an engine incorporating the improved cylinder head.

2. Background Art

The intake ports of internal combustion engines are formed in the cylinder head of the engine. Each intake port consists of a passage which leads from an inlet side, at an upstream end thereof, through the cylinder head and to an opening of a combustion chamber. During engine operation, intake air is guided into the combustion chamber through the intake ports. An intake valve, which opens and closes the intake opening of the combustion chamber, has a valve stem extending perpendicularly from the center of the opening. In order to minimize the effect of the presence of the valve stem, the intake port extends upwardly and outwardly, in a curved shape, from the intake opening of the combustion chamber.

A valve guide is, therefore, fixed to a curved wall formed in the cylinder head. The curved wall is located on a side of the cylinder head which is spaced away from a center of curvature of the intake port. The intake valve is freely slidably supported by the valve guide.

Thus, in a common intake port configuration, an intake port extends from an upstream end, at an upper side of the cylinder head, to a downstream end at an opening of a combustion chamber. The valve guide is situated at a location in the intake port such that the valve stem is substantially aligned with a central vertical axis of the intake port. Such a configuration is disclosed, for example, JP-A No. 301119/1995.

In common cases, the portion downstream of the location of the valve guide of an intake port leads to an opening of a combustion chamber with almost no change in passage cross-sectional area.

Therefore, in this conventional design, the intake air flowing into the intake port is, after flowing curvedly along a curved wall surface, led perpendicularly to the intake opening of the combustion chamber as it is, without being caused to spread or being compressed. Most of the intake air then directed toward a circular end portion of an intake valve. In this arrangement, the intake air entering the combustion chamber is subjected to a large resistance so that it is difficult to improve the efficiency of intake into the combustion chamber.

The present invention has been made in view of the above problem, and it is an object of the present invention to provide cylinder head having an improved intake port configuration including an improved intake port passage configuration, to allow intake air to flow into a combustion chamber more efficiently than with previously known cylinder head designs.

SUMMARY OF THE INVENTION

To achieve the above object, a first aspect of the invention provides a cylinder head for an internal combustion engine, the cylinder head having an improved intake port configuration. The cylinder head has an intake valve which opens and closes an opening of a combustion chamber, and which has a valve stem freely slidably supported by a valve guide fixed to an intermediate location on a curved wall of an intake port. The intake port extends in a curving path, from a hole opened in a lateral side of the cylinder head to an opening in the upper side of the combustion chamber. In the intake port configuration of the cylinder head according to the first aspect hereof, a cross-sectional area of a downstream portion of the intake port reduces with an increasing distance, in the upstream direction, from the intake opening of the combustion chamber. The passage cross-sectional area at a location which is upstream from the intake opening of the combustion chamber by a distance equal to about 10% of a total length of the intake port is 0.8 times the area of the opening at the combustion chamber, or smaller.

The downstream portion of the intake port leads to the intake opening of the combustion chamber with the passage cross-section of the intake port rapidly enlarging, as compared with a conventional intake port, in a section between the intake opening of the combustion chamber and a location which is upstream by a distance equal to about 10% of the total length of the intake port (the passage cross-sectional area at the location is less than or equal to 0.8 times the cross-sectional area of the opening at the combustion chamber). In this arrangement, when the intake valve opens into the combustion chamber, the intake air enters the combustion chamber via the opening after starting, immediately [in advance of the opening], spreading rapidly outwardly.

The air that enters the combustion chamber spreads rapidly outwardly, as noted, and advances smoothly along a curved surface of a circular end portion of the intake valve. The intake valve is located immediately downstream of the intake opening of the combustion chamber, and is curvedly shaped so as to spread like the foot of a mountain. In this arrangement, the intake flow resistance is reduced, and the efficiency of air intake into the combustion chamber can be improved.

Since the air enters the combustion chamber while expanding rapidly, even if a stagnation layer of air is formed near the wall surface of the intake port, the real air flow passage area enlarges to further improve the efficiency of air intake into the combustion chamber.

A second aspect of the invention provides a cylinder head having an improved intake port configuration for an internal combustion engine. The intake port according to the second aspect includes an intake valve which opens and closes an intake opening of a combustion chamber. The intake port has a valve guide fixed to an intermediate location on a curved wall thereof, and a valve stem is freely slidably supported by the valve guide. The intake port extends in a curved manner through the cylinder head, from an entry hole opened in a side of the cylinder head to the intake opening of the combustion chamber. In the intake port configuration, a portion of the intake port downstream of the valve guide has a passage cross-section whose shape continuously changes, and the portion includes a location where the longitudinal-to-transverse diameter ratio of the passage cross-section is 0.9 or smaller.

The longitudinal direction of an arbitrary passage cross-section of the intake port is defined as the direction in which the line of intersection between a plane which includes both the center of the arbitrary passage cross-section and an axial line of the valve stem and the plane including the arbitrary passage cross-section, extends. The transverse direction of the arbitrary passage cross-section is defined as the direction perpendicular to the longitudinal direction. Based on the foregoing, a longitudinal-to-transverse diameter ratio refers to the ratio of the longitudinal diameter to the transverse diameter (the longitudinal diameter divided by the transverse diameter), where the longitudinal diameter is the largest width in the longitudinal direction of the arbitrary passage cross-section and the transverse diameter is the largest width in the transverse direction of the arbitrary passage cross-section.

In a section downstream of the valve guide of the intake port, there is a location where the passage cross-section has an elliptical shape whose longitudinal diameter is significantly smaller than the transverse diameter, with the longitudinal-to-transverse diameter ratio being 0.9 or smaller. Therefore, the air flowing in through the intake port enters the combustion chamber after traveling, while spreading in the longitudinal direction, from a portion where the cross-section has an elliptical shape whose longitudinal diameter is smaller than the transverse diameter with the longitudinal-to-transverse diameter ratio being 0.9 or smaller, to a portion including the perfectly circular opening of the combustion chamber. Of all the air flowing into the combustion chamber, the air that comes along the curved wall surface, and that flows into the combustion chamber forming an angle more perpendicular to a circular end portion of the intake valve than the corresponding angles formed by the air that comes other than along the curved wall surface, can be transformed into an outwardly spreading air flow. Therefore, the air coming along the curved wall surface can advance smoothly along the curved surface of the circular end portion of the intake valve, immediately after entering the combustion chamber. In this manner, the resistance to the flow of air entering the combustion chamber is reduced, so that the efficiency of air intake into the combustion chamber can be improved.

A third aspect of the invention provides the intake port configuration according to either of the first or second aspects, and is further characterized in that the portion downstream of the valve guide of the intake port has a curved wall surface which is transformed, via an inflection point, into a reverse curved wall surface, the reverse curved wall surface leading, spreading outwardly, to the intake opening of the combustion chamber.

Of the air flowing into the combustion chamber, the air that comes along the curved wall surface and that flows into the combustion chamber forming an angle more perpendicular to the circular end portion of the intake valve than the corresponding angles formed by the air that comes other than along the curved wall surface can be transformed, gradually and smoothly, into an outwardly spreading air flow immediately before reaching the intake opening of the combustion chamber. This allows the air coming along the curved wall surface to further advance along the curved surface of the circular end portion of the intake valve. In this manner, the resistance to the air entering the combustion chamber is reduced so that the efficiency of air intake into the combustion chamber can be further improved.

For a more complete understanding of the present invention, the reader is referred to the following detailed description section, which should be read in conjunction with the accompanying drawings. Throughout the following drawings and description, like numbers refer to like parts. The above-mentioned object, other objects, characteristics and advantages of the present invention will become apparent form the detailed description of the embodiment of the invention presented below in conjunction with the attached drawings.

DETAILED DESCRIPTION OF THE INVENTION

A number of selected illustrative embodiments of the present invention will be explained in the following discussion, with reference to FIGS. 1 to 6.

Figure 1:
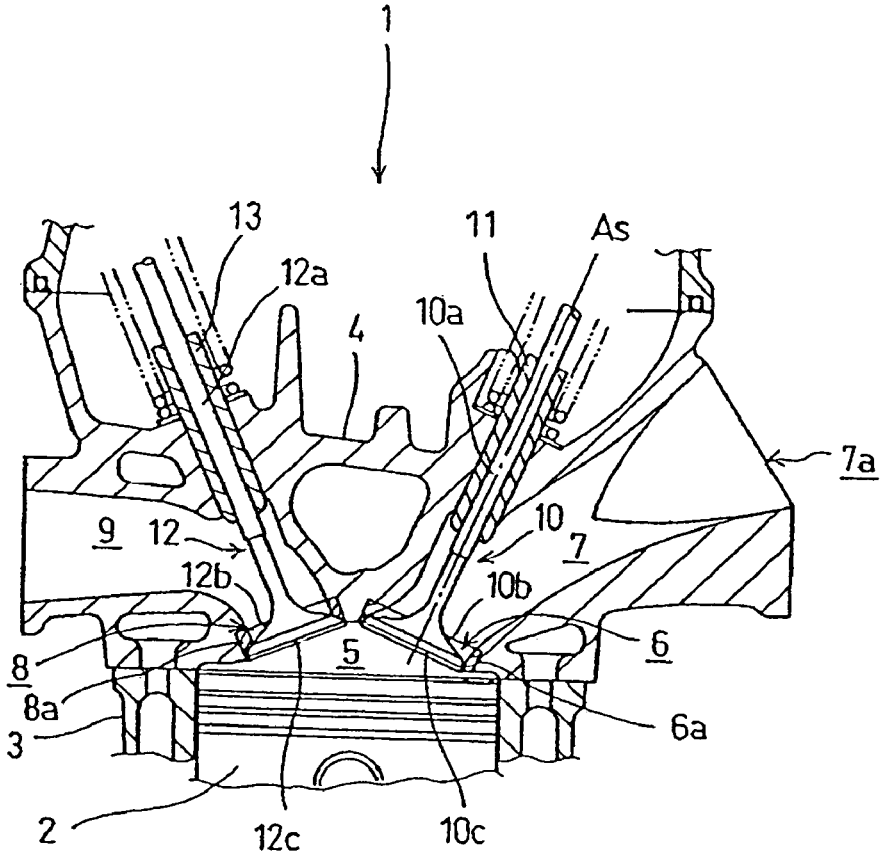
FIG. 1 is a sectional view of a selected portion of an internal combustion engine, including a cylinder head according to a selected illustrative embodiment of the present invention, and showing the valves supported by valve guides within the respective intake and exhaust ports.

An internal combustion engine 1, according to the present illustrative embodiment of the present invention, is a four-stroke type of internal combustion engine, with four valves per cylinder. FIG. 1 is sectional view of a selected portion of the internal combustion engine 1, including a cylinder head 4 according to a selected illustrative embodiment of the present invention, and showing the valves 10, 12 supported by respective valve guides 11, 13 within the respective intake and exhaust ports 7, 9.

The cylinder head 4 is fitted to a cylinder block 3, in which a piston 2 is freely slidably fitted into a cylinder bore. The cylinder head 4 cooperates with a top surface of the piston 2 to define a combustion chamber 5, which is positioned above the piston 2 and adjacent to where the cylinder head 4 and the cylinder block 3 are joined. The combustion chamber 5 has a so-called pent roof, formed of a pair of substantially flat roof planes intersected at an obtuse angle to form a high center portion.

One of the roof planes has a pair of inlets 6, 6 formed therein (only one of which is shown in the Figure), and the cylinder head 4 has intake ports 7, 7 formed therein and extending along a curving path from these intake ports toward the upper side of the cylinder head 4. The two intake ports 7, 7 join into one. Namely, the intake port 7 is an air intake passage formed by opening a hole in a side portion of the cylinder head 4, in which the hole is divided into two branches, both curving into the combustion chamber 5 via the inlets 6, 6.

The other of the roof planes has a pair of outlets 8, 8 formed therein (only one of which is shown in the Figure), and the cylinder head 4 has exhaust ports 9, 9 formed therein and curvedly extending in a direction substantially opposite to the direction in which the intake ports 7, 7 extend. Each of the inlets 6, 6 has a circular intake valve seat 6*a* removably installed therein, and each of the outlets 8, 8 has a circular exhaust valve seat 8*a* removably installed therein.

An intake valve 10, which opens and closes the inlet 6, has a valve stem 10*a* extending through a valve guide 11 fitted to a curved wall opposite the center of curvature of the intake port 7, at a location partway along the length of the intake port 7 (This curved wall may be thought of as an outer curved wall of the intake port 7, although it is situated towards a central portion of the cylinder head 4). The valve 10 is freely slidably supported in the valve guide 11. A valve face 10*c*, at a periphery of a circular end portion 10*b* of the valve stem 10*a*, comes in touch with and lifts off from a valve seat 6*a* to close and open the inlet 6.

Similarly, an exhaust valve 12 which opens and closes the outlet 8 has a valve stem 12*a* extending through a valve guide 13 fitted to a curved wall at a location partway along the length of the exhaust port 9, and is thereby freely slidably supported by the valve guide 13. A valve face 12*c*, extending around a periphery of a circular end portion 12*b* of the valve stem 12*a*, comes in touch with and lifts off from a valve seat 8*a* to close and open the outlet 8.

A conventional valve train (not shown) which drives the intake valve 10 and the exhaust valve 12 is provided above the cylinder head 4.

The intake port 7 of the internal combustion engine 1 will be explained in more detail in the following.

Figure 2:
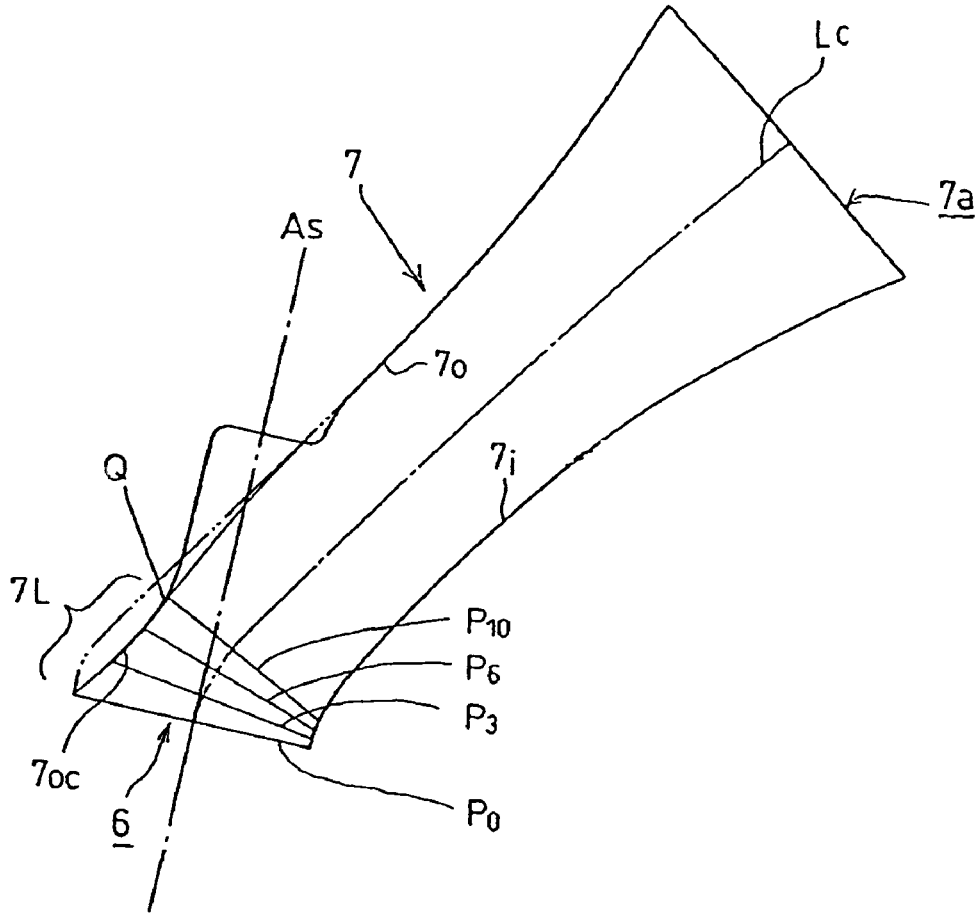
FIG. 2 is a detail view of a portion of the cylinder head of FIG. 1, showing an outline shape of an intake port.

FIG. 2 is side view showing an outline shape of the intake port 7 as seen when the intake port 7 is cut longitudinally in a plane including an axis line As of the intake valve 10. A center line Lc of the curved intake port 7 is also curved. A passage cross-section of the intake port 7 is a cross-section obtained by cutting the intake port 7 in a plane perpendicular to the center line Lc.

Figure 5:
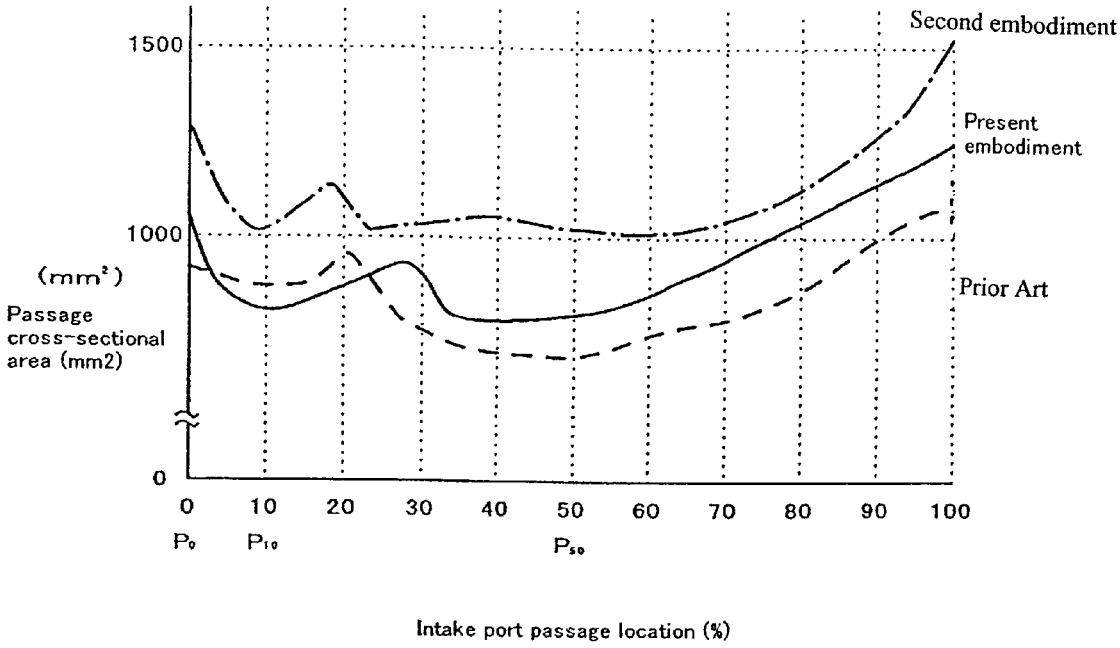
FIG. 5 is a graph showing changes in the passage cross-sectional area of the intake port with respect to intake port passage location in which values corresponding to illustrative embodiments of the present invention are graphed, along with comparative values corresponding to the prior art.

Changes in the cross-sectional area of the intake passage over a region between the inlet 6 and an upstream connection port 7*a* (an opening, in the side wall of the cylinder head 4, forming an upstream end of the intake port 7 to be connected to an intake pipe) are shown in solid line in the graph of FIG. 5. The horizontal axis of the graph in FIG. 5 represents locations along the intake passage leading from the inlet 6 to the upstream connection port 7*a* in terms of the distance, represented in percentage of the total length of the intake passage, from the inlet 6.

When changes in the cross-sectional area of the intake passage are followed in the upstream direction starting from the 0% passage location (the inlet 6) $P_0$, the following is observed. The cross-sectional area of the intake passage rapidly decreases in the section from the 0% passage location (the inlet 6) $P_0$ to the 10% passage location $P_{10}$, gradually increases in the section from the 10% passage location $P_{10}$ to near the 30% passage location $P_{30}$ where the valve guide 11 is located, decreases again in the section from the 30% passage location $P_{30}$ to around the 40% passage location $P_{40}$, and then gradually increases in the subsequent section leading to the 100% passage location (the upstream connection port 7*a*) $P_{100}$.

As for a downstream portion 7L of the intake port 7, that is, the section from the inlet 6 to the 10% passage location $P_{10}$, the cross-sectional area of the intake passage at the 10% passage location $P_{10}$ is as small as 0.8 or less times the area of opening of the inlet 6.

Changes in the cross-sectional area of the intake passage along the downstream portion 7L of the intake port 7 are shown in FIG. 3. Shown in FIG. 3 are cross-sections taken at the 0% passage location (the inlet 6) $P_0$, the 3% passage location $P_3$, the 6% passage location $P_6$, and the 10% passage location $P_{10}$, as shown in FIG. 2, of the intake port 7.

Figure 3A:
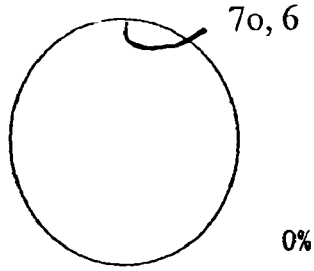
FIG. 3A shows the passage cross-sectional shape of a portion of the intake port of FIG. 2 located at the inlet to the combustion chamber.

FIG. 3A shows a cross-section, which is perfectly circular, taken at the 0% passage location $P_0$ (the inlet 6) of the intake passage.

Figure 3B:
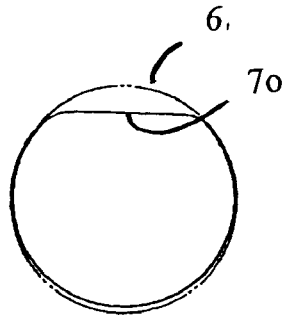
FIG. 3B shows the passage cross-sectional shape of a portion of the intake port of FIG. 2 at a location corresponding to 3 percent of the total length of the intake port upstream from the inlet to the combustion chamber.

FIG. 3B shows a cross-section taken at the 3% passage location $P_3$ of the intake passage. This cross-section, compared with the perfectly circular cross-section taken at the inlet 6, shows flattened top and bottom portions with the flattening being particularly noticeable at the top portion and represents a large decrease in the cross-sectional area.

Figure 3C:
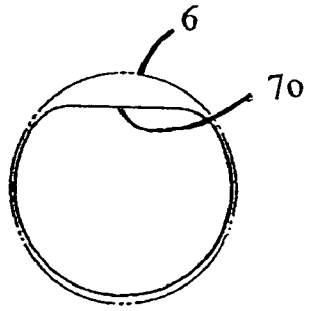
FIG. 3C shows the passage cross-sectional shape of a portion of the intake port of FIG. 2 at a location corresponding to 6 percent of the total length of the intake port upstream from the inlet to the combustion chamber.

FIG. 3C shows a cross-section taken at the 6% passage location $P_6$ of the intake passage. In this cross-section, the top and bottom portions are further depressed, with the reduction particularly noticeable in the top portion, and represents a further decrease in the cross-sectional area compared with that of FIG. 3B.

Figure 3D:
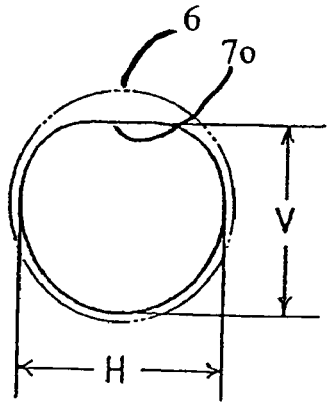
FIG. 3D shows the passage cross-sectional shape of a portion of the intake port of FIG. 2 at a location corresponding to 10 percent of the total length of the intake port upstream from the inlet to the combustion chamber.

FIG. 3D shows a cross-section taken at the 10% passage location $P_{10}$ of the intake passage. This cross-section represents an overall reduction from the cross-section taken at the 6% passage location $P_6$, as shown in FIG. 3C, but the rate of reduction is small.

Changes in the cross-sectional area of the intake passage of a conventional (prior art) general intake port are shown in broken line in the graph of FIG. 5. Comparing the 0% passage location (inlet) $P_0$ and the 10% passage location $P_{10}$ of the conventional intake port, it is known that the cross-sectional area at the 10% passage location $P_{10}$ is about 0.96 times the area of opening of the inlet, representing a small gradual decrease.

Thus, comparison between the intake port according to the present embodiment and the conventional intake port makes it clear that, in the downstream portion 7L, i.e., over the section leading from the inlet 6 to the 10% passage location $P_{10}$, of the intake port 7 according to the present embodiment, the cross-sectional area rapidly decreases as shown in FIG. 3.

Observing changes in the cross-sectional area of the intake passage of the intake port 7 in the direction of intake, it is known that the intake passage gradually narrows over the section leading to the downstream portion 7L and, after reaching the 10% passage location $P_{10}$, enlarges its cross-sectional area, first slowly and then rapidly, over the subsequent section leading to the inlet 6.

Thus, when the intake valve 10 opens the inlet 6 to cause the air to be led into the combustion chamber 5 via the upstream section of the intake port 7, the air enters the combustion chamber 5 via the inlet 6, after starting a rapid outward expansion immediately in advance of the inlet 6.

Figure 4:
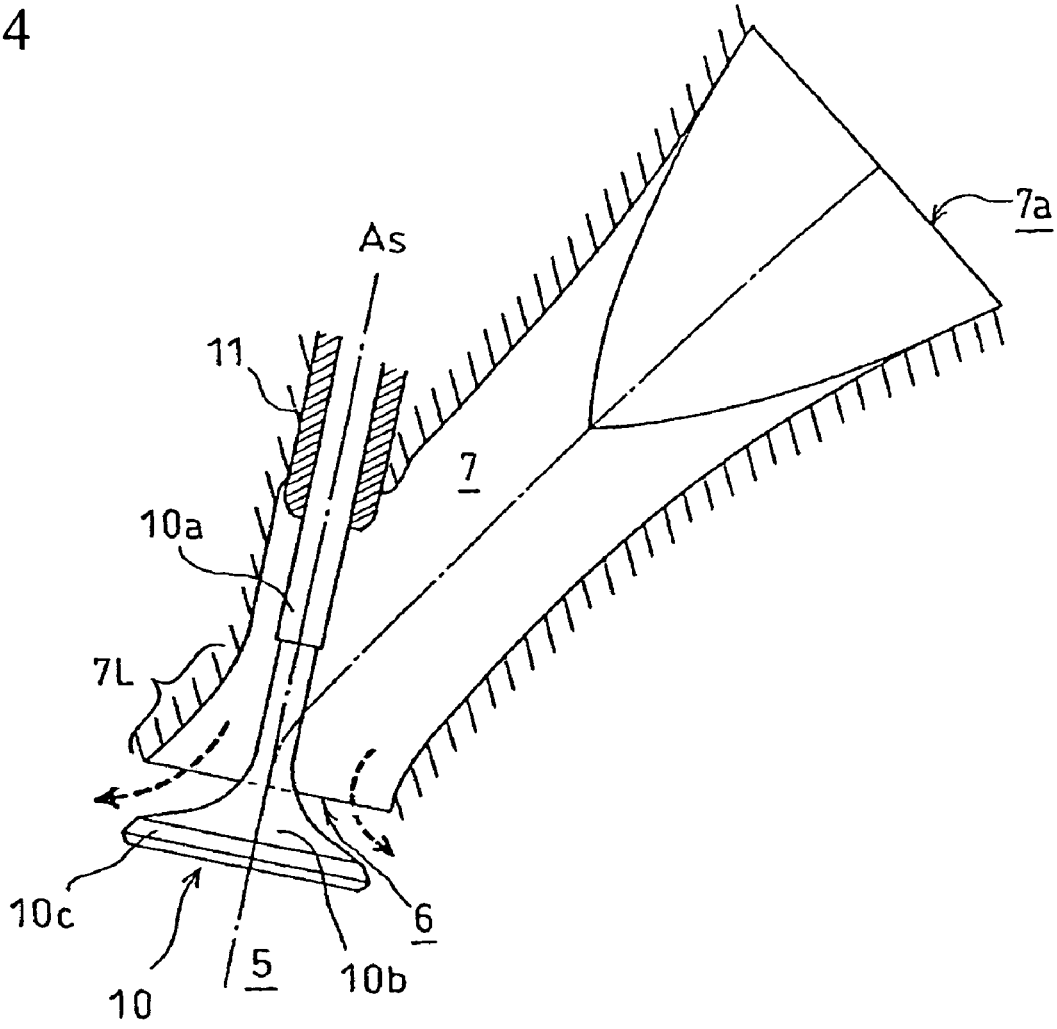
FIG. 4 is a sectional detail view of a portion of the cylinder head of FIG. 1, showing the intake port and an intake valve extending into the intake port, and illustrating a smooth flow of air over a curved surface of a circular end portion of the intake valve.

The rapidly expanding air entering the combustion chamber 5 is, immediately after entering the combustion chamber 5 via the inlet 6, guided smoothly along the curved surface of the circular end portion 10*b* as shown by the broken-line arrows in FIG. 4. In this manner, resistance to the flow of air entering the combustion chamber 5 is reduced, so that a higher intake efficiency can be achieved.

As the air enters the combustion chamber while expanding rapidly, even if a stagnation layer of air is formed near the wall surface of the intake port, the real air flow passage area enlarges to further increase the efficiency of air intake into the combustion chamber.

In the intake port 7, the passage cross-section in the downstream portion 7L also varies between passage locations as shown in FIG. 3.

The initially circular passage cross-section is changed to have flattened portions. A depression resulting from flattening is particularly noticeable in the top portion of the passage cross-section as shown in FIG. 3. With reference to FIG. 2, the reference numeral 7*o* denotes a curved wall surface on the farther side from the center of curvature of the curved intake port 7, and the reference numeral 7*i* denotes an inner curved wall surface on the closer side to the center of curvature of the curved intake port 7. The top portions of the passage cross-sections shown in FIG. 3 correspond to the outer curved wall surface 7*o*. Compared with an intake port shown in chain double-dashed line in FIG. 2, whose passage cross-section is approximately perfectly circular, the outer curved wall surface 7*o* of the intake port 7 includes a portion apparently more depressed than the other portions.

The downstream portion 7L of the outer curved wall surface 7*o* of the intake port 7 includes an inflection point Q located near the 10% passage location $P_{10}$. A reverse outer curved wall surface 7*oc* is located downstream of the inflection point Q (see FIG. 2). The reverse outer curved wall surface 7*oc* extends from the inflection point Q to the inlet 6.

The air coming along the outer curved wall surface 7*o*, in conventional cases, most sharply changes its flow direction, as shown in chain double-dashed line in FIG. 2, to enter the combustion chamber. The air coming along the outer curved wall surface 7*o* is therefore made to enter the combustion chamber forming an angle more perpendicular to the circular end portion 10*b* of the intake valve 10 than the corresponding angles formed by the air coming other than along the outer curved wall surface 7*o*. In the case of the intake port 7, however, the reverse outer curved wall surface 7*oc* provided in front of the inlet 6 allows the air coming along the outer curved wall surface 7*o* to gradually and smoothly change its flow direction outwardly, just before entering the combustion chamber 5 via the inlet 6.

As a result, the air coming along the outer curved wall surface 7*o* can follow a course of flow as shown by a broken line arrow in FIG. 4 to form an air flow along the curved surface of the circular end portion 10*b* of the intake valve 10. In this manner, the resistance to the air entering the combustion chamber 5 is reduced so that the intake efficiency can be further improved.

Changes in the passage cross-sectional area of an intake port according to a second embodiment of the invention whose passage cross-section is generally larger than that of the intake port 7 according to the present embodiment are shown in dot-dashed line in the graph of FIG. 5.

The passage cross-section of the intake port of the second embodiment is generally larger than that of the intake port 7. Whereas the intake port 7 has the largest cross-section at a location near the 30% passage location $P_{30}$, the intake port of the second embodiment has the largest cross-section at a location near the 20% passage location $P_{20}$. With regard to the ratio of the passage cross-sectional area at the 10% passage location $P_{10}$ to the area of opening of the inlet, however, the passage cross-sectional area at the 10% passage location $P_{10}$ of the intake port of the second embodiment is as small as 0.78 times the area of opening of the inlet 6.

When, as described above, the passage cross-sectional area at the 10% passage location $P_{10}$ is as small as 0.8 or less times the area of opening of the inlet, the air is allowed to rapidly spread outwardly immediately before entering the combustion chamber and subsequently advance smoothly along the circular end portion of the intake valve. In this manner, the resistance to the air entering the combustion chamber is reduced so that the intake efficiency can be improved.

Next, regarding the cross-sectional shape of the passage of the intake port 7, the longitudinal-to-transverse diameter ratio will be examined. When a circular passage cross-section is partly flattened, the ratio represents the degree of flatness.

As stated above, the longitudinal direction of an arbitrary passage cross-section of the intake port 7 is defined as the direction in which the line of intersection between a plane which includes both the center of the arbitrary passage cross-section and an axial line As of the valve stem 10*a* and a plane including the arbitrary passage cross-section, extends, and the transverse direction of the arbitrary passage cross-section is defined as the direction perpendicular to the longitudinal direction. In this case, the longitudinal-to-transverse diameter ratio is given by V/H, where V is the largest width in the longitudinal direction of the arbitrary passage cross-section and H is the largest width in the transverse direction of the arbitrary passage cross-section.

In FIG. 3 showing passage cross-sections, the top-bottom direction and the lateral direction represent the longitudinal direction and the transverse direction, respectively, of the passage cross-sections. Consider a passage cross-section at the 10% passage location $P_{10}$, for example, the largest width in the longitudinal direction is the longitudinal diameter V and the largest width in the transverse direction is the transverse diameter H, as shown FIG. 3D. The ratio V/H of the longitudinal diameter V to the transverse diameter H represents the longitudinal-to-transverse diameter ratio of the passage cross-section at the 10% passage location $P_{10}$.

Figure 6:
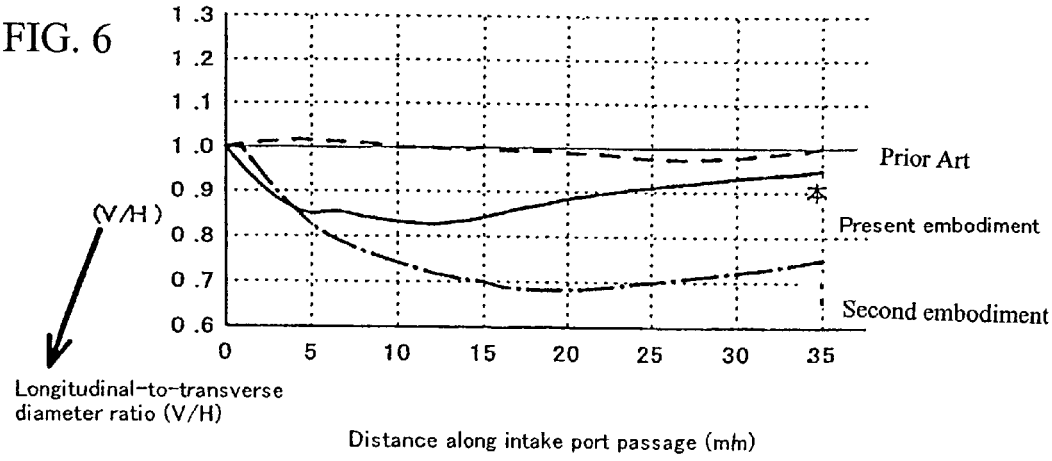
FIG. 6 is a graph showing changes in the longitudinal-to-transverse diameter ratio V/H in a downstream portion of the intake port with respect to distance along the intake port passage in which values corresponding to illustrative embodiments of the present invention are graphed, along with comparative values corresponding to the prior art.

Changes in the longitudinal-to-transverse diameter ratio V/H along the downstream portion 7L of the intake port 7 according to the present embodiment are shown in solid line in the graph of FIG. 6. In the graph of FIG. 6, a level representing a longitudinal-to-transverse diameter ratio V/H of 1.0 corresponds to perfectly circular passage cross-sections. In the graph, the area above the "V/H=1" level line corresponds to passage cross-sections with a longitudinal diameter larger than a transverse diameter, that is, passage cross-sections reduced in the transverse direction. The area below the "V/H=1" level line corresponds to passage cross-sections with a longitudinal diameter smaller than a transverse diameter, that is, passage cross-sections reduced in the longitudinal direction. In the graph, the greater distance from the "V/H=1" level line corresponds to passage cross-sections with a larger degree of flatness.

In FIG. 6, the horizontal axis represents the distance measured from the inlet 6 in the upstream direction. The valve guide 11 is located at about 30 mm from the inlet 6. In FIG. 6, the curve in the solid line that represents the intake port 7 according to the present embodiment is in the area below the "V/H=1" level line indicating that the cross-section of the intake port 7 is shaped like what was initially perfectly circular reduced in the longitudinal direction. The longitudinal-to-traverse diameter ratio V/H of the cross-section of the intake port 7 is smaller than 0.9 in a section from 3 mm to 25 mm from the inlet 6.

In FIG. 6, the curve in broken line represents a conventional intake port. The longitudinal-to-transverse diameter ratio V/H of the downstream portion of the conventional intake port stays in a narrow range going slightly above or below the "V/H=1" level line indicating that the cross-section of the downstream portion of the conventional intake port remains approximately perfectly circular.

Compared with the case of the conventional intake port, the cross-section in a section downstream of the valve guide 11 of the intake port 7 according to the present embodiment has an elliptical shape whose longitudinal diameter is comparatively significantly smaller than the transverse diameter with the longitudinal-to-transverse diameter ratio being 0.9 or smaller.

Therefore, the air flowing in the intake port 7 enters the combustion chamber 5 after traveling, while spreading in the longitudinal direction, from a portion where the cross-section has an elliptical shape whose longitudinal diameter is smaller than the transverse diameter with its longitudinal-to-transverse diameter ratio being 0.9 or smaller, to the inlet 6 having a perfectly circular cross-section. Of the air flowing into the combustion chamber 5, the air that comes along the outer curved wall surface 7*o* and that flows into the combustion chamber 5 forming an angle more perpendicular to the circular end portion of the intake valve than the corresponding angles formed by the air that comes other than along the outer curved wall surface 7*o* can be transformed into an outwardly spreading air flow. Thus, the air coming along the outer curved wall surface 7*o* can, immediately after entering the combustion chamber 5 via the inlet 6, advance smoothly, as shown with a broken line arrow in FIG. 4, along the curved surface of the circular end portion 10*b* of the intake valve 10. In this manner, the resistance to the air entering the combustion chamber 5 is reduced so that the efficiency of air intake into the combustion chamber 5 can be improved.

As described in the foregoing, the downstream portion 7L of the outer curved wall surface 7*o* of the intake port 7 has the inflection point Q in the vicinity of the 10% passage location $P_{10}$ and the reverse outer curved wall surface 7*oc* is provided downstream of the inflection point Q (see FIG. 2). Therefore, when the air coming along the outer curved wall surface 7*o* arrives in front of the inlet 6, it can be gradually and smoothly transformed into an outwardly spreading air flow before entering the combustion chamber 5. As a result, the air, after entering the combustion chamber 5, can form an intake air flow along the curved surface of the circular end portion 10*b* of the intake valve 10. In this manner, the resistance to the air entering the combustion chamber 5 is reduced and the intake efficiency can be further improved.

In FIG. 6, the curve in dot-dashed line represents the intake port of a second embodiment of the invention. In the downstream portion 7L of the intake port of the second embodiment, the passage cross-section is perfectly circular (longitudinal-to-transverse diameter ratio V/H=1) in a portion very close to the inlet. The longitudinal-to-transverse diameter ratio V/H of the passage cross-section rapidly decreases with an increasing distance away from the inlet, increasingly reducing the longitudinal diameter of the passage cross-section. The longitudinal-to-transverse diameter ratio V/H is the smallest, being 0.68, at a location 18 mm from the inlet, that is, the longitudinal diameter of the passage cross-section is most reduced at the location.

The above arrangement enables the air flow coming along the curved wall surface to be more noticeably transformed into an outwardly spreading air flow. As a result, the air can, immediately after entering the combustion chamber via the inlet, advance smoothly along the curved surface, spreading like the foot of a mountain, of the circular end portion of the intake valve. In this manner, the resistance to the air entering the combustion chamber is reduced so that the efficiency of air intake into the combustion chamber can be improved.

While a working example of the present invention has been described above, the present invention is not limited to the working example described above, but various design alterations may be carried out without departing from the present invention as set forth in the claims.

What is claimed is:

1. In an internal combustion engine of the type having a combustion chamber formed therein and including:

a cylinder head with an intake opening formed therein for delivering an intake mixture to the combustion chamber, said cylinder head also having an intake port formed therein which communicates with the intake opening;

an intake valve which has a valve stem and which is operable to open and close the intake opening of the combustion chamber; and a valve guide which slidably supports the valve stem therein;

wherein the improvement comprises an improved configuration of said cylinder head comprising an improved intake port configuration in said cylinder head, wherein said intake port is curved in shape and leads from a hole formed in a side portion of the cylinder head to the intake opening of the combustion chamber;

wherein the valve guide is fixed to the cylinder head at an intermediate location on a curved wall of the curved intake port, wherein a passage cross-sectional area of the intake port reduces with an increasing distance from the intake opening of the combustion chamber in a region of the intake port adjacent to the intake opening of the combustion chamber, and wherein the passage cross-sectional area, at a location which is spaced approximately 10% of a total length of the intake port from an opening thereof at the combustion chamber, is less than or equal to 0.8 times an area of the intake port at the intake opening of the combustion chamber.

2. The improved cylinder head according to claim 1, wherein the cylinder head is configured such that:

a portion of the intake port between the intake opening of the combustion chamber and the valve guide has a curved wall surface which is transformed, via an inflection point, into a wall surface of reversed curvature, the wall surface of reversed curvature provided with continuously increasing cross sectional area as distance increases from the inflection point to the intake opening of the combustion chamber.

3. The improved cylinder head according to claim 1, wherein the cylinder head is configured such that:

a first passage cross section of the intake port, located at the intake opening of the combustion chamber, has a circular shape, the first passage cross section having a first cross-sectional area, and a second passage cross section of the intake port, located adjacent to the intake opening of the combustion chamber, has a modified circular shape, which is modified such that an edge of the passage cross section which corresponds to said curved wall of the curved intake port is flattened, the second passage cross section having a second cross-sectional area, wherein the first passage cross-sectional area is greater than the second passage cross-sectional area.

4. The improved cylinder head according to claim 1, wherein the cylinder head is configured such that during operation of the engine, upon opening of the intake valve, intake air enters the combustion chamber from the intake port in a manner such that the intake air expands rapidly prior to passing through the intake opening and into the combustion chamber.

5. The improved cylinder head according to claim 1, wherein the cylinder head is configured such that the longitudinal direction of an arbitrary passage cross-section of the intake port is defined as the direction in which the line of intersection between a plane which includes both the center of the arbitrary passage cross-section and an axial line of the valve stem and the plane including the arbitrary passage cross-section, extends, and in which the transverse direction of the arbitrary passage cross-section is defined as the direction perpendicular to the longitudinal direction, such that the longitudinal diameter is the largest width in the longitudinal direction of the arbitrary passage cross-section and the transverse diameter is the largest width in the transverse direction of the arbitrary passage cross-section, wherein in portions of the intake port corresponding a distance between approximately 3 mm to 25 mm from the intake opening of the combustion chamber, the longitudinal-to-transverse diameter ratio is less than 0.9.

6. The improved cylinder head according to claim 5, wherein the cylinder head is configured such that at the intake opening of the combustion chamber, the longitudinal-to-transverse diameter ratio is 1.0.

7. An internal combustion engine, comprising:

a cylinder head having part of a combustion chamber formed therein with an intake opening in an upper end of the combustion chamber;

an intake valve which opens and closes the intake opening of the combustion chamber and which comprises a valve stem; and a valve guide which supports the valve stem such that the valve stem freely slides within the valve guide;

wherein said cylinder head has an intake port formed therein which is curved in shape and which leads from a hole opened in a side of the cylinder head to the intake opening of the combustion chamber;

wherein the valve guide is fixed to the cylinder head at an intermediate location on a curved wall of the intake port;

wherein a portion of the intake port between the intake opening of the combustion chamber and the valve guide has a passage cross-section whose shape continuously changes, the portion including a location where a longitudinal-to-transverse diameter ratio of the passage cross-section is less than or equal to 0.9.

8. The internal combustion engine according to claim 7, wherein the cylinder head is configured such that a portion of the intake port between the intake opening of the combustion chamber and the valve guide has a curved wall surface which is transformed, via an inflection point, into a wall surface of reversed curvature, the wall surface of reversed curvature provided with continuously increasing cross sectional area as distance increases from the inflection point to the intake opening of the combustion chamber.

9. The internal combustion engine according to claim 7, wherein the cylinder head is configured such that:

a first passage cross section of the intake port, located at the intake opening of the combustion chamber, has a circular shape, the first passage cross section having a first cross-sectional area, and a second passage cross section of the intake port, located adjacent to the intake opening of the combustion chamber, has a generally circular shape which is modified such that an edge of the passage cross section which corresponds to said curved wall of the curved intake port is flattened, the second passage cross section having a second cross-sectional area, wherein the first passage cross-sectional area is greater than the second passage cross-sectional area.

10. The internal combustion engine according to claim 7, wherein the cylinder head is configured such that during engine operation, upon opening of the intake valve, intake air enters the combustion chamber from the intake port such that the intake air rapidly expands immediately prior to passing through the intake opening of the combustion chamber.

11. The internal combustion engine according to claim 7, wherein the cylinder head is configured such that:

a passage cross-sectional area of the intake port which reduces with an increasing distance from the intake opening of the combustion chamber in the region adjacent to the intake opening of the combustion chamber, and the passage cross-sectional area which, at a location which is spaced from the intake opening of the combustion chamber a distance equal to approximately 10% of a total length of the intake port, is not greater than 0.8 times an area of the intake opening of the combustion chamber.

12. The internal combustion engine according to claim 7, wherein the cylinder head is configured such that a portion of the intake port coinciding with the intake opening of the combustion chamber has passage cross-section in which the longitudinal-to-transverse diameter ratio thereof is 1.0.

* * * * *